US005673551A

United States Patent [19]

Döbbeling

[11] Patent Number: 5,673,551

[45] Date of Patent: Oct. 7, 1997

[54] PREMIXING CHAMBER FOR OPERATING AN INTERNAL COMBUSTION ENGINE, A COMBUSTION CHAMBER OF A GAS TURBINE GROUP OR A FIRING SYSTEM

[75] Inventor: Klaus Döbbeling, Nussbaumen, Switzerland

[73] Assignee: Asea Brown Boveri AG, Baden, Switzerland

[21] Appl. No.: 714,890

[22] Filed: Sep. 17, 1996

Related U.S. Application Data

[63] Continuation of Ser. No. 495,711, Jun. 27, 1995, abandoned, which is a continuation of Ser. No. 233,302, Apr. 25, 1994, abandoned.

[30] Foreign Application Priority Data

May 17, 1993 [DE] Germany ..... 43 16 474.9

[51] Int. Cl.[6] ..... F02G 3/00

[52] U.S. Cl. ..... 60/39.06; 60/737; 60/748; 60/39.463; 60/266; 431/8; 431/350

[58] Field of Search ..... 60/39.06, 39.463, 60/39.464, 39.465, 266, 737, 738, 742, 748, 747, 732; 431/8, 9, 350, 353

[56] References Cited

U.S. PATENT DOCUMENTS

| | | | |
|---|---|---|---|
| 2,671,313 | 3/1954 | Laramee | 60/266 |
| 3,638,865 | 2/1972 | McEneny et al. | 60/742 |
| 3,736,746 | 6/1973 | Dubell et al. | 60/737 |
| 3,820,320 | 6/1974 | Schirmer et al. | 60/748 |
| 3,866,413 | 2/1975 | Sturgess | 60/742 |
| 3,872,664 | 3/1975 | Lohmann et al. . | |
| 3,915,619 | 10/1975 | Quigg | 431/10 |
| 3,984,528 | 10/1976 | Cheng et al. | 431/8 |
| 4,021,188 | 5/1977 | Yamagishi et al. | 431/9 |
| 4,120,640 | 10/1978 | Martin | 431/353 |
| 4,362,021 | 12/1982 | Willis | 60/748 |
| 4,373,325 | 2/1983 | Skekleton | 60/39.06 |
| 4,425,755 | 1/1984 | Hughes | 60/748 |
| 4,971,552 | 11/1990 | Fukuda et al. | 431/9 |
| 5,020,039 | 5/1991 | Ekstedt et al. | 60/737 |
| 5,127,821 | 7/1992 | Keller | 431/8 |
| 5,156,002 | 10/1992 | Mowill | 60/738 |
| 5,228,283 | 7/1993 | Schicchetti | 60/742 |
| 5,244,380 | 9/1993 | Dobbeling et al. | 431/8 |
| 5,295,352 | 3/1994 | Beebe et al. | 60/737 |
| 5,303,554 | 4/1994 | Faulkner | 60/737 |
| 5,345,768 | 9/1994 | Washam et al. | 60/737 |
| 5,375,995 | 12/1994 | Dobbeling et al. | 431/8 |
| 5,477,685 | 12/1995 | Samuelson et al. | 60/737 |

FOREIGN PATENT DOCUMENTS

| | | | |
|---|---|---|---|
| 321 809 A1 | 6/1989 | European Pat. Off. . | |
| 321 809 B1 | 5/1991 | European Pat. Off. . | |
| 521325 | 1/1993 | European Pat. Off. . | |
| 2321091 | 3/1977 | France . | |
| 853535 | 10/1952 | Germany . | |
| 1013467 | 8/1957 | Germany | 60/737 |
| 2141575 | 6/1977 | Germany . | |
| 0237326 | 9/1989 | Japan | 60/737 |
| 1579957 | 11/1980 | United Kingdom . | |
| 2150277 | 6/1985 | United Kingdom | 60/737 |

*Primary Examiner*—Timothy Thorpe
*Assistant Examiner*—Ted Kim
*Attorney, Agent, or Firm*—Oblon, Spivak, McClelland, Maier & Neustadt, P.C.

[57] ABSTRACT

In a premixing burner for the operation of an internal combustion engine, a combustion chamber of a gas turbine group or a firing system, which burner can be used for the combustion of fuels with very different properties, a diffuser (4) is arranged after a swirl generator (1), a convergent part (2) and a throat (3) for the supply of the fuel (9). The convergent part (2), the throat (3) and the diffuser (4) have a rotationally symmetrical configuration and the variation in cross section is adapted in such a way that no flow separation is possible at the wall. Gaseous fuels having a high flame speed are introduced counter to the swirl generated by the swirl generator (1). Gaseous fuels having a low flame speed are introduced in the same direction as the swirl generated by the swirl generator (1).

5 Claims, 2 Drawing Sheets

FIG. 1
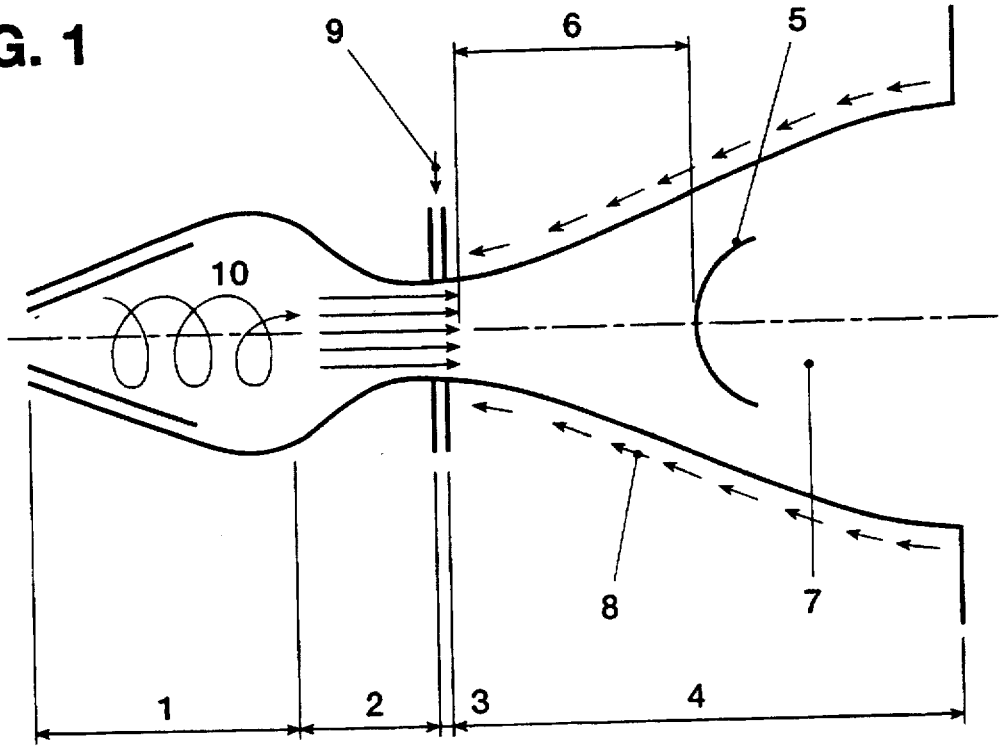
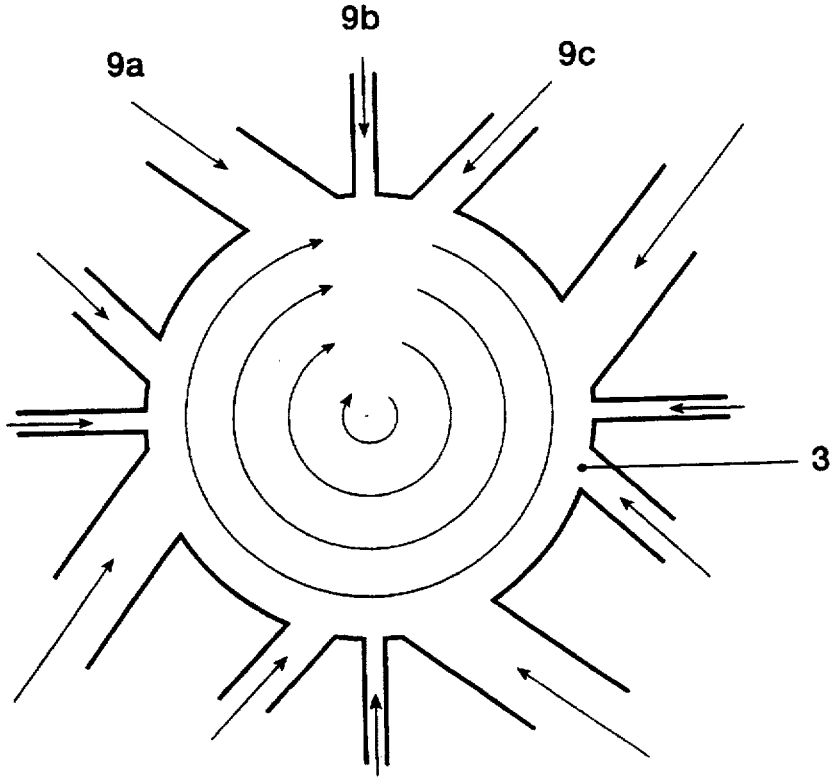
FIG. 2

PREMIXING CHAMBER FOR OPERATING AN INTERNAL COMBUSTION ENGINE, A COMBUSTION CHAMBER OF A GAS TURBINE GROUP OR A FIRING SYSTEM

This application is a Continuation of application Ser. No. 08/495,711, filed on Jun. 27, 1995, now abandoned, which is a continuation of application Ser. No. 08/233,302, filed on Apr. 25, 1994 now abandoned.

BACKGROUND OF THE INVENTION

1. Field of the Invention

The invention relates to a premixing burner for operating an internal combustion engine, a combustion chamber of a gas turbine group or a firing system and an associated method, which burner and method are suitable for the combustion of fuels with very different properties.

2. Discussion of Background

Premixing burners, i.e. burners in which the premixing zone is an integrated constituent of the burner itself and which are characterized by low $NO_x$ emissions, are known (EP-A1 0 321 809, 0 521 325).

These burners ensure that the ignition of the fuel/air mixture takes places at a location where there is no excessive flow velocity of the medium. At the same time, care is taken to ensure that the propagation of the flame front takes place in a defined manner in the direction of the burner outlet where the flame front becomes established.

In the known premixing burners, problems arise when fuels with very different properties have to be burned. The flow field must then be designed so as to ensure that for all the fuels, the mixing is completed before the flame zone is reached and that the flames do not, under any circumstances, flash back to the admixture location. In addition, there should be no uncooled inserts, such as swirl generators or flame holders, in the regions which can be reached by the flame under certain operating conditions, i.e. wherever a fuel/air mixture is present. If swirl generators are arranged in the mixture flow, for example, the known disadvantages—such as formation of deposits or the destruction of the swirl vanes by overheating—arise.

A further disadvantage of the known premixing burners consists in the fact that their operation is problematic away from the design point and in the case of partial failure—leaks in the cooling air system, for example. If, namely, attempts are made to run with a weaker mixture during part-load operation, the burnout deteriorates in the case of the known burners and the CO/UHC emissions greatly increase (CO/UHC-$NO_x$ dilemma).

SUMMARY OF THE INVENTION

Accordingly, one object of the invention is to avoid all these disadvantages and to provide a novel premixing burner for the operation of an internal combustion engine, a combustion chamber of a gas turbine group or a firing system and to provide an associated method, which burner and method have low $NO_x$ emissions, in which fuels with very different properties can be burned without problems and in which the function of the burner is also ensured away from the design point and in the case of partial failure.

This is achieved in accordance with the invention, wherein the premixing burner consists of a swirl generator, a convergent part adjoining it, a throat for the supply of fuel and a diffuser. This is achieved in accordance with the invention in the method for operating the premixing burner, wherein, when operating with fuels which have a high flame speed (relative to methane as a reference, i.e., greater than 0.4 meters per second at a pressure of 1 bar, a preheating temperature of 300K and an equivalence ratio of 1), the fuels are introduced in the opposite direction; when operating with fuels which have a low flame (i.e., less than methane) speed and a low calorific value, the fuels are introduced in the same direction and, when operating with liquid or pulverized fuel, the fuel is introduced at the narrowest cross section with respect to the flow velocity or shortly before the narrowest cross section by means of a central lance.

The advantages of the invention may, inter alia, be seen in that the mixing is completed before the flame front is reached in the case of the combustion of fuels with very different properties and in that the flame cannot flash back to the admixture location. The main reaction zone is stabilized in a purely aerodynamic manner without it touching the burner wall. Furthermore, there are no reverse flow zones, steps or sudden area increases in the flame zone. The functioning of the burner is also ensured away from the design point and in the case of partial failure. In addition, the burner can be used in a combustion process with staging of air or fuel.

It is particularly expedient for the convergent part, the throat and the diffuser to have a rotationally symmetrical configuration because secondary flows are then avoided and only low turbulence is present before the vortex breakdown.

It is also expedient for the variation in cross section to be adapted in such a way that no flow separation is possible at the wall.

Finally, a double-cone burner with adapted slot width and with the fuel injection missing, or a guide vane swirl generator is advantageously used as the swirl generator. The swirl generators without hub blockage are particularly advantageous because these operate practically without loss and cause a strong axial flow on the axis.

In addition, it is advantageous for the premixing burner, in particular the diffuser, to be cooled convectively. Reliable burner operation is ensured by this even if the flame makes contact in the end region of the diffuser.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a longitudinal section through the premixing burner;

FIG. 2 shows a section through the narrowest cross section (position where the fuel is introduced) of the embodiment the premixing burner.

DESCRIPTION OF THE PREFERRED EMBODIMENTS

Figure 3:
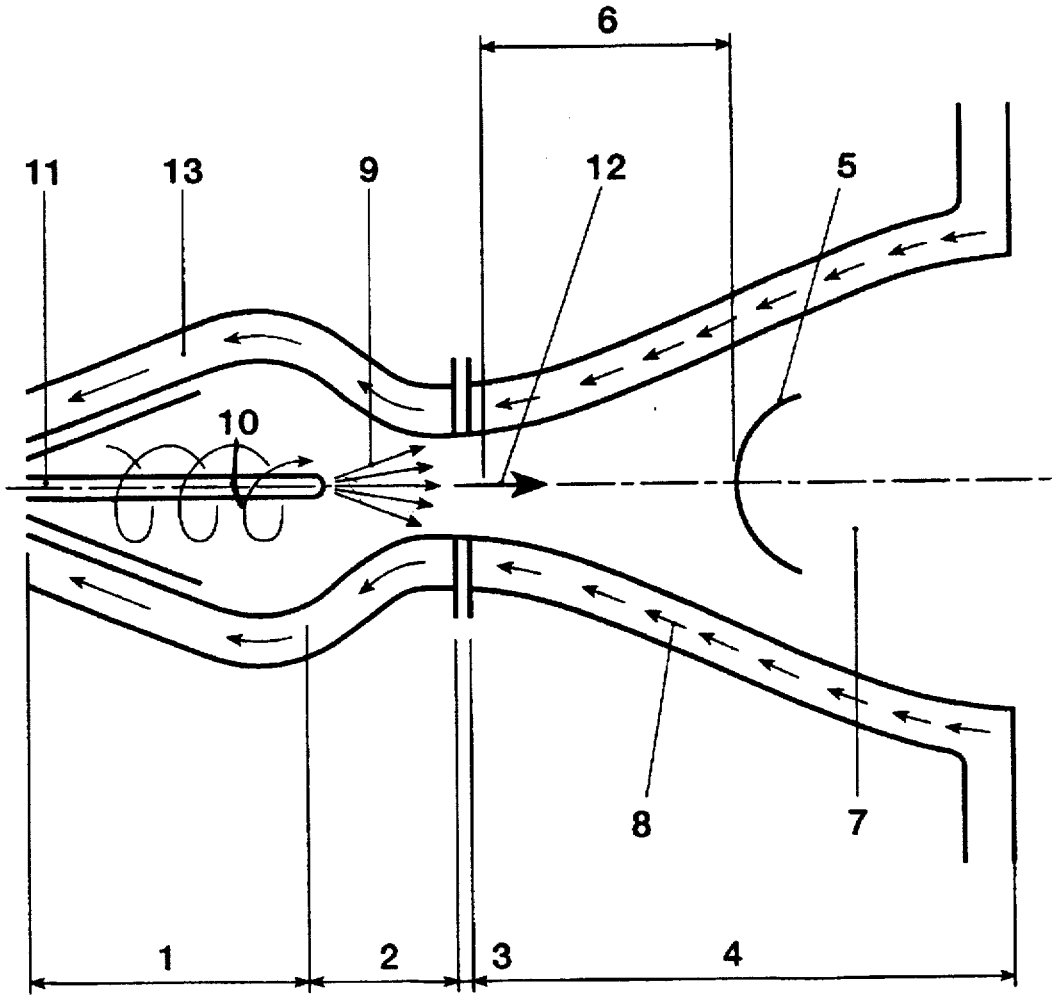
FIG. 3 corresponds to FIG. 2 but shows another embodiment of the premixing burner.

Referring now to the drawings, wherein like reference numerals designate identical or corres-ponding parts throughout the several views, where only the elements essential for understanding the invention are shown and where the flow direction of the working media is indicated by arrows, the premixing burner represented in FIG. 1, which is used for the combustion of fuels with very different properties, consists of a swirl generator 1, a convergent part 2 adjoining it, a throat 3 and a diffuser 4. A flow field with a total pressure which is as constant as possible is generated in the swirl generator 1. Because of the vortex generated, the premixing burner according to the invention can also be designated as a vortex-diffuser burner. The convergent part 2, the throat 3 and the diffuser 4 have a rotationally symmetrical configuration in order to avoid secondary flows and their variation in cross section is adapted in such a way that the increase in area takes place at just such a rate that no flow separation from the wall takes place. In order to keep the friction losses—and the surface which may have to be cooled—small, the length of the rotationally symmetrical parts is as short as possible. This gives small mixing lengths.

Subject to the condition of a sufficiently high Reynolds number in the burner and subject to the boundary conditions of the desired heat output and the desired overall length, the design size of the burner can be arbitrarily chosen.

A double-cone burner with an adapted slot width (without introduction of fuel such as that disclosed in EP 0321 809) is the unit especially suitable as the swirl generator 1. A guide vane swirl generator or a swirl generator with or without a hub body can, of course, be used as the swirl generator 1 in the case of other embodiment examples. Swirl generators 1 which operate substantially without loss and which cause a strong axial flow on the axis are particularly advantageous. This is achieved in the case of swirl generators without hub blockage.

In the convergent part 2, the flow velocity increases until it reaches its highest value at the throat 3. The admixture of the fuel 9 takes place at the throat 3, the location with the highest flow velocity. This achieves the effect that the fuel 9 mixes rapidly with the combustion air 10, that the mixing is completed before the flame zone is reached and that the flame cannot, under any circumstances, flash back to the fuel admixture location. The upstream fuel pressure necessary for mixing is only slight.

There are no inserts, such as swirl generators or flame holders for example, present in the mixing zone, i.e. where the fuel/air mixture is present (premixing distance 6, main reaction zone 7). Swirl number changes to suit the fuel 9 are possible without moving parts in the burner. In addition, there are no reverse flow zones, steps or sudden area increases in the flame zone so that good flame stability (small pulsations) is achieved.

Because of the axisymmetrical geometry, only low turbulence is present before the vortex breakdown 5.

The main reaction zone 7 is stabilized in a purely aerodynamic manner due to the breakdown of the swirl flow (vortex breakdown 5) without it touching the burner wall.

In the embodiment example represented in FIG. 1, the divergent part of the burner is cooled convectively. The combined burner and combustion chamber cooling flow 8 in cooling passage 13 (FIG. 3) achieves the effect that even if the flame comes into contact in the end region of the diffuser 4, reliable burner operation is still ensured. In a different embodiment example, the whole of the burner can, of course, be completely cooled relatively simply by convective cooling and it is therefore also suitable for operation as a stage burner in a system with air or fuel staging, for example as the first, second or third stage.

If the premixing burner is operated with fuels which have a high flame speed (short ignition delay times), the fuels must be introduced in the opposite direction (FIG. 2). This greatly weakens the vortex breakdown 5. If, on the other hand, fuels with a low flame speed and low calorific value are used, the flame stabilization is improved by introducing the fuel in the same direction and, by this means, strengthening the vortex breakdown 5.

When the burner is operated with liquid or pulverized fuel, the latter is introduced at the narrowest cross section, i.e. at the throat 3, with respect to the flow direction 12 of the air or shortly before the narrowest cross section by means of a central lance 11 (FIG. 3).

The burner is a system with multi-fuel capability because, as may be seen from FIG. 2, low calorific value fuels 9*a*, natural gas 9*b* and gases 9*c* containing hydrogen can, for example, be used.

A further advantage consists in the fact that the burner remains fully functional away from the design point and in the case of partial failure, if there are leaks in the cooling air system for example. Finally, the low $NO_x$ emissions should also be emphasized.

Obviously, numerous modifications and variations of the present invention are possible in light of the above teachings. It is therefore to be understood that within the scope of the appended claims, the invention may be practiced otherwise than as specifically described herein.

| LIST OF DESIGNATIONS | |
|---|---|
| 1 | Swirl generator |
| 2 | Convergent part |
| 3 | Throat |
| 4 | Diffuser |
| 5 | Vortex breakdown |
| 6 | Premixing distance |
| 7 | Main reaction zone |
| 8 | Combined burner and combustion chamber cooling |
| 9 | Fuel |
| 9a | Low calorific value fuel |
| 9b | Natural gas |
| 9c | Gases containing hydrogen |
| 10 | Combustion air |

What is claimed as new and desired to be secured by letters patent of the United States is:

1. A method of operating a premixing burner of a combustion chamber of a gas turbine group including a swirl generator, a convergent part adjoining the swirl generator, a throat for supplying fuel to the combustion chamber and a diffuser, said method comprising the steps of:

using the swirl generator to introduce air travelling in an axial flow path and in a swirl direction about a rotational axis within the axial flow path of the swirling air;

a first step of introducing, at the narrowest cross section of the throat with respect to an axial component of a flow direction of the air, one of a gaseous fuel having a high flame speed relative to methane and a gaseous fuel having a low flame speed relative to methane; and a second step of introducing, at said narrowest cross section, the other of a gaseous fuel having a high flame speed relative to methane and a gaseous fuel having a low flame speed relative to methane, wherein when introducing a gaseous fuel having a high flame speed, said introducing step comprises introducing the fuel in a direction having an angular component which is opposite said swirl direction, and wherein when introducing a gaseous fuel having a low flame speed, said introducing step comprises introducing the fuel in a direction having an angular component which is the same as said swirl direction.

2. The method of claim 1 including the step of introducing one of a liquid fuel and a pulverized fuel at said narrowest cross section of the throat.

3. The method of claim 1 including the step of introducing one of a liquid fuel and a pulverized fuel in a pattern having at least a radial component and via a central lance, at a position just upstream of said narrowest cross section of the throat.

4. A method of operating a premixing burner of a combustion chamber of a gas turbine group including a swirl generator, a convergent part adjoining the swirl generator, a throat for supplying fuel to the combustion chamber and a diffuser, said method comprising the steps of:

using the swirl generator to introduce air travelling in an axial flow path in a swirl direction about a rotational axis within the axial flow path of the swirling air;

a first step of introducing one of a gaseous fuel having a high flame speed relative to methane, a gaseous fuel having a low flame speed relative to methane, a liquid fuel and a pulverized fuel; and a second step of introducing another of a gaseous fuel having a high flame speed relative to methane, a gaseous fuel having a low flame speed relative to methane, a liquid fuel and a pulverized fuel, wherein where the fuel introduced in said first introducing step is one of a gaseous fuel having a high flame speed relative to methane or a low flame speed relative to methane, the fuel introduced in said second introducing step is a gaseous fuel having the other of a high flame speed relative to methane or a low flame speed relative to methane, wherein when introducing a gaseous fuel having a high flame speed, said introducing step comprises introducing the fuel in a direction having an angular component which is opposite said swirl direction, wherein when introducing a gaseous fuel having a low flame speed, said introducing step comprises introducing the fuel in a direction having an angular component which is the same as said swirl direction, and when introducing one of a liquid fuel and a pulverized fuel, the fuel is introduced, at the narrowest cross section of the throat with respect to an axial component of a flow direction of the air.

5. A method of operating a premixing burner of a combustion chamber of a gas turbine group including a swirl generator, a convergent part adjoining the swirl generator, a throat for supplying fuel to the combustion chamber and a diffuser, said method comprising the steps of:

using the swirl generator to introduce air travelling in an axial flow path in a swirl direction about a rotational axis within the axial flow path of the swirling air;

a first step of introducing one of a gaseous fuel having a high flame speed, a gaseous fuel having a low flame speed, a liquid fuel and a pulverized fuel; and a second step of introducing another of a gaseous fuel having a high flame speed relative to methane, a gaseous fuel having a low flame speed relative to methane, a liquid fuel and a pulverized fuel, wherein where the fuel introduced in said first introducing step is one of a gaseous fuel having a high flame speed relative to methane or a low flame speed relative to methane, the fuel introduced in said second introducing step is a gaseous fuel having the other of a high flame speed relative to methane or a low flame speed relative to methane, wherein when introducing a gaseous fuel having a high flame speed relative to methane, said introducing step comprises introducing the fuel in a direction having an angular component which is opposite said swirl direction, wherein when introducing a gaseous fuel having a low flame speed relative to methane, said introducing step comprises introducing the fuel in a direction having an angular component which is the same as said swirl direction, and when introducing one of a liquid fuel and a pulverized fuel, the fuel is introduced, in a pattern having at least a radial component and via a central lance, at a position just upstream of the narrowest cross section of the throat with respect to an axial component of a flow direction of the air.

* * * * *